US011060169B2

(12) United States Patent
Yanez et al.

(10) Patent No.: US 11,060,169 B2
(45) Date of Patent: Jul. 13, 2021

(54) NI—AL BASE MATERIAL HAVING OPTIMIZED OXIDATION RESISTANT AT HIGH TEMPERATURES AND FURNACE TRANSFER ROLLS MADE THEREFROM

(71) Applicant: ArcelorMittal, Luxembourg (LU)

(72) Inventors: Tanya Ros Yanez, Valparaiso, IN (US); Amar Kumar De, Munster, IN (US)

(73) Assignee: ArcelorMital, Luxembourg (LU)

( * ) Notice: Subject to any disclaimer, the term of this patent is extended or adjusted under 35 U.S.C. 154(b) by 784 days.

(21) Appl. No.: 13/738,257

(22) Filed: Jan. 10, 2013

(65) Prior Publication Data

US 2014/0193290 A1 Jul. 10, 2014
US 2016/0215368 A9 Jul. 28, 2016

Related U.S. Application Data

(60) Provisional application No. 61/585,087, filed on Jan. 10, 2012.

(51) Int. Cl.
*C22C 19/05* (2006.01)
*C22C 19/00* (2006.01)

(52) U.S. Cl.
CPC ..... *C22C 19/057* (2013.01); *C22C 19/007* (2013.01)

(58) Field of Classification Search
CPC ..... C22C 19/007; C22C 19/057
USPC ..... 148/675; 420/445, 449; 219/128
See application file for complete search history.

(56) References Cited

U.S. PATENT DOCUMENTS 3,801,357 A * 4/1974 Baldi ..... C23C 10/02 106/316
5,108,700 A * 4/1992 Liu ..... C22C 19/058 148/410
5,698,006 A 12/1997 Ishiyama
2004/0055725 A1* 3/2004 Ray ..... B22C 3/00 164/72
2012/0175355 A1* 7/2012 Lalam ..... 219/128

FOREIGN PATENT DOCUMENTS

CA 2129523 A1 8/1993
JP 5588856 7/1980
JP 55110748 8/1980
JP 5669342 6/1981
JP 08218139 8/1996

OTHER PUBLICATIONS

Whittenberger J.D. et al., "Elevated temperature compressive properties of Zr- modified NiAl.", Metallurgical and Materials Transactions A, vol. 27, (199609), p. 2628, 2629, Sep. 1996.
Santella M.L. et al., "Development of Ni3A1 alloys for use as transfer rolls in hot processing of steels.", Oak Ridge National Laboratory, (199605), May 1996.

* cited by examiner

*Primary Examiner* — Jenny R Wu
(74) *Attorney, Agent, or Firm* — Davidson, Davidson & Kappel, LLC

(57) ABSTRACT

A high temperature oxidation resistant nickel-aluminide alloy composition and furnace rolls formed therefrom. The inventive nickel-aluminide alloy composition comprises 0.08-0.1 wt. % Zr, 2.5-3.0 wt. % Mo, 7.5-8.5 wt. % Al, 7.5-8.5 wt. % Cr, about 0.01 wt. % B and the balance being substantially nickel.

20 Claims, 1 Drawing Sheet

NI—AL BASE MATERIAL HAVING OPTIMIZED OXIDATION RESISTANT AT HIGH TEMPERATURES AND FURNACE TRANSFER ROLLS MADE THEREFROM

CROSS-REFERENCE TO RELATED APPLICATIONS

This Application claims the benefit under 35 U.S.C. 119(e) of U.S. Provisional Application No. 61/585,087 filed Jan. 10, 2012.

FIELD OF THE INVENTION

The present invention relates generally to Ni—Al compositions. More specifically, the Ni—Al compositions have optimized oxidation resistant at high temperatures. Most specifically, the invention relates to Ni—Al compositions useful in producing austenitizing furnace transfer rolls.

BACKGROUND OF THE INVENTION

The most common transfer roll alloy material in use today in austenitizing furnaces is an H-series austenitic alloy that provides limited high-temperature strength, wear and oxidation resistance. After a short service of a few months the rolls show deterioration. Finally, after two to three years inside the annealing furnace the transfer rolls need to be removed from service because of a variety of major issues. First, the rolls tend to sag at the current operating temperatures becoming eccentric in their rotation, which also limits increased efficiency for operating at even higher processing temperatures. The rolls at temperatures and loading condition undergo local distortion (bulges) which requires hand-grinding the bulges. The iron oxide on the plates are transferred to the rolls and then back onto the plates. The performance of the rolls (which have bulges, distortions and oxidation) cause the plate to undergo quality degradation. To avoid such degradation, the furnace is frequently shut down and the rolls are ground or replaced to minimize the defects. The energy used to restart the furnace after the shutdown is also an important factor in maximizing energy savings.

A number of years ago, the use of nickel aluminide alloys (specifically, IC-221M developed by ORNL) to form transfer rolls was proposed as a solution to the issues with H-series austenitic alloy rolls because of Ni—Al's superior high temperature strength, wear and oxidation resistance, as well as for better plate surface quality control. Unfortunately, after about 4 years in service, the Ni-aluminide rolls develop a green scale on the surface thereof. Furthermore, scale in the form of protrusions from the surface cause indentations on the bottom surface of the plate during heat treatment. Since these indentations on the plate are a quality concern, the present inventors examined the cause of this problem.

The study was dedicated to understanding the Ni—Aluminide alloy and its oxidation behavior through microstructural changes and oxidation behavior of the Ni-aluminide rolls. The mechanisms and kinetics of oxidation of the rolls subjected to the prolonged exposure to the hardening temperature was established through laboratory simulations. An extensive metallographic investigation using optical microscopy, SEM, EDS and Micro Raman spectroscopy was carried out on samples from the rolls in as-cast condition, after use in the hardening furnace for more than 4 years and after laboratory oxidation simulations.

The results of this study reveal long term oxidation phenomena at high temperature as the cause of the surface deterioration. The oxidation mechanism of the Ni aluminide rolls can be summarized as follow: (1) at 900° C. in air the oxides form in a manner that follows the microsegregation patterns in the as-cast microstructure; (2) the γ+Ni5Zr eutectic colonies provide a fast diffusion path; (3) the first oxide nodules to form protrude from the surface in the vicinity of the γ+$Ni_5Zr$ eutectic regions; (4) the dominant oxide of the nodules is NiO, but $Al_2O_3$ and $NiAl_2O_4$ are present in significant quantities; (5) NiO nodules protrude above the surface and an Al-depleted zone grows beneath the surface oxide; (6) internal oxides stringers mainly composed of Zr extend from the alloy surface into the parent matrix.

Two types of oxides were detected on the rolls after service in the hardening furnace. In general, the surface of the rolls is covered by numerous round shaped green nodules referred to as primary oxides that tend to coalesce and create dimples. These oxide nodules present a dense external NiO layer above a subscale consisting of a mixture of NiO, $Al_2O_3$ and $Ni(Cr,Al)_2O_4$ oxides.

Black oxides that protrude from the surface referred to as secondary oxides are difficult to remove as they are well attached to the surface. These nodules consisted of an exterior layer of $Fe_3O_4$ and $Fe_2O_3$ followed by an inner and thicker layer of a mixture of NiO, $Al_2O_3$ and $Ni(Cr,Al)_2O_4$ oxides. In general, the outer layers of the secondary oxides where Fe is present exhibit higher hardness values than the primary oxides. The Fe oxide layer develops through contact at high temperature between the plates and the primary oxides that protrude from the rolls.

The appearance of oxide scales, in the form of dimples or nodules, on the surface of the nickel aluminide rolls is inevitable with the present alloy used to make the rolls and the required service conditions.

Thus, there is a need in the art for austenitizing furnace rolls formed from material that retains the superior high temperature strength, wear and oxidation resistance of the present Ni—Al material, but avoids the formation of oxide scales, in the form of dimples or nodules, on the surface of the rolls.

SUMMARY OF THE INVENTION

The present invention comprises a high temperature oxidation resistant nickel-aluminide alloy composition and furnace rolls formed therefrom. The nickel-aluminide alloy may comprise 0.15 wt % or less Zr, and preferably may comprise from about 0.08-0.1 wt % Zr. The alloy may further comprise from about 2.5 to 3.0 wt. % Mo, and preferably may comprise about 2.8 wt % Mo. The alloy may further comprises from about 7.5 to 8.5 wt. % Al, and from about 7.5 to 8.5 wt. % Cr. The nickel-aluminide alloy may further comprises less than about 0.015 wt. % B, preferably about 0.01 wt. % B. The alloy may further comprise, in wt. %: C—0.05 max; Si—0.1 max; Fe—0.3 max; S—0.005 max; Mn—0.1 max; P—0.01 max; and Cu—0.3 max. The alloy may contain no more than trace amounts of the other elements from group IVB, VB and VIB of the periodic table.

DETAILED DESCRIPTION OF THE INVENTION

Figure 1A:
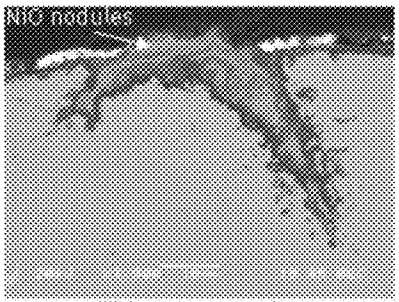
FIGS. 1*a*-1*i* are cross sectional SEM images of samples having varied Zr content (M-0=0 wt. % Zr, M-2=0.3 wt. % Zr, and the prior art alloy IC-221M=1.8 wt. % Zr), oxidized at 900° C. for 1500, 3000 and 18000 hrs inside a hardening furnace.

The inventive Ni—Al compositions provide the superior strength and creep properties of the Ni aluminide family and solve the oxidation problems that the prior composition/rolls experienced in high temperature service. The new Ni aluminide alloy composition comprises 0.08-0.1 wt. % Zr, 2.5-3.0 wt. % Mo, 7.5-8.5 wt. % Al, 7.5-8.5 wt. % Cr, about 0.01 wt. % B and the balance being substantially nickel. This new composition will extend the life of the Ni-aluminide transfer rolls use in the plate mill austenitizing furnaces and will sustain the use of Ni-aluminide rolls for superior temperature strength, wear, oxidation resistance and better plate surface quality control.

Thus, the new alloy composition will reduce the number of plates rejected due to surface marks. Further, in terms of energy costs, there are five major benefits of using Ni-aluminide rolls in comparison with HP-type of rolls: (1) energy savings due to the elimination of shutdowns and restarts for roll repair and maintenance, (2) energy savings due to straight through processing, (3) cost savings due to the elimination of roll maintenance labor, (4) fewer plates downgraded or rejected as the result of elimination of HP-type roll bulging and the oxide protrusions in the prior art Ni—Al rolls, (5) cost savings due to the reduction in roll inventory because of longer roll life.

The present inventors conducted an extensive investigation to understand the oxidation behavior of the prior art Ni—Al alloy through the microstructural changes and oxidation behavior of the Ni-aluminide rolls. The mechanisms and kinetics of oxidation of the rolls subjected to the prolonged exposure to the hardening temperature was established through the analysis of rolls in service and oxidation laboratory simulations. The results of the study showed that the presence of Zr in the alloy was detrimental to the oxidation properties at operation temperatures due to preferential oxidation of Zr which in turn creates a non-uniform oxidation of the surface.

The study also showed that nickel-oxide nodules are formed as protrusions on the roll surface in a manner that follows the micro-segregation patterns in the as-cast microstructure. It was seen that internal oxidation that extended from the roll surface into the matrix was highly concentrated in the vicinity of the zirconium inclusions or the eutectic zones. Further, NiO nodules were responsible for the formation of the hard protrusions on the rolls and hence to the rolls surface deterioration due to their growth, coalescence and/or spallation.

Despite the oxidation problems exhibited by the prior art alloy, Ni-aluminide alloys, in general, provide excellent strength and creep properties at high temperature with a roll life 3 times longer than HP alloy roll. Therefore, the present inventors set about redesigning the Ni-aluminide roll chemistry to develop an alloy that prevents formation of detrimental oxide nodules.

The first phase of the study investigated Ni aluminide alloys with variable Zr (0-1 wt. %) and Mo(0-3 wt. %). Samples were produced for oxidation simulations in laboratory and industrial environments. The oxidation behavior of the samples in the laboratory conditions were examined after 72, 900, 1500, 3000 and 5000 hrs at 900° C. to down-select the most promising alloys. Afterwards, long-term oxidation experiments were performed with selected alloys inside an actual furnace environment for up to 18,000 hours and a correlation with the laboratory results was established.

Figure 1B:
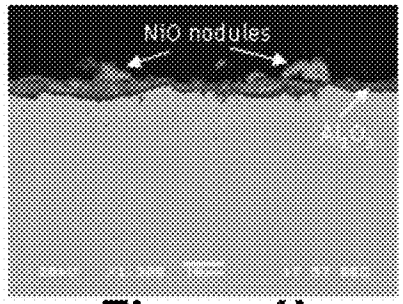
Figure 1C:
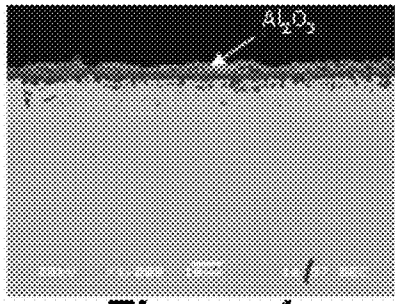
Figure 1D:
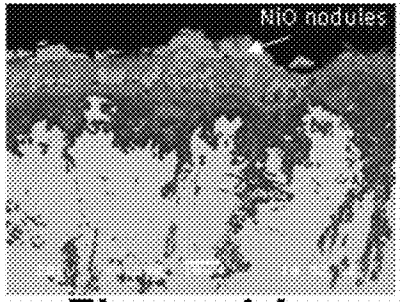
Figure 1E:
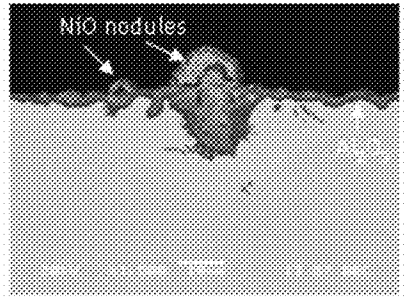
Figure 1F:
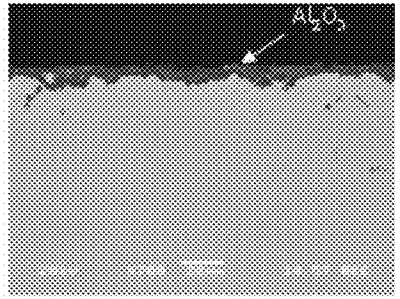
Figure 1G:
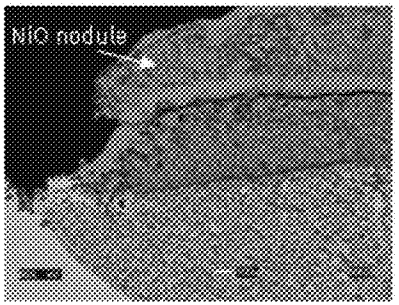
Figure 1H:
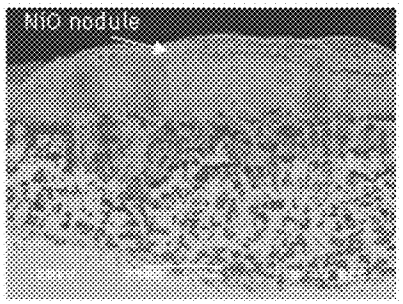
Figure 1I:
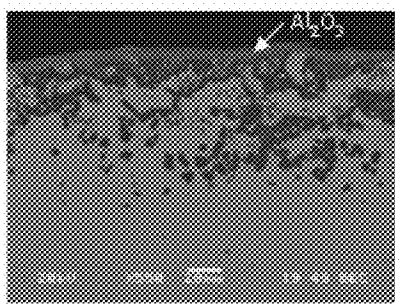

FIGS. 1*a*-1*i* are cross sectional SEM images of samples having varied Zr content (M-0=0 wt. % Zr, M-2=0.3 wt. % Zr, and the prior art alloy IC-221M=1.8 wt. % Zr), oxidized at 900° C. for 1500, 3000 and 18000 hrs inside a hardening furnace. FIGS. 1*a*-1*c* are the results of the three samples, IC-221M, M-2, and M-0, respectively, oxidized at 900° C. for 1500 hours. As can be seen from FIG. 1*a*, even at this sort of service time, the prior art alloy (with 1.8 wt. % Zr) has developed significant NiO nodules on the surface thereof. Further, it can be seen from FIG. 1*b* that the alloy with 0.3 wt % Zr starts to form small NiO nodules as well. Significantly, the alloy with no Zr does not form any NiO nodules, but instead forms a protective $Al_2O_3$ surface, see FIG. 1*c*.

As the oxidation time is increased to 3000 and finally 18,000 hours it can be seen that NiO nodules of the sample having 1.8 wt. % Zr and the sample having 0.3 wt. % Zr grow significantly. This can be seen in FIGS. 1*d*, 1*g* (1.8 wt. % Zr) and 1*e*, 1*h* (0.3 wt. % Zr). In contradistinction thereto, the alloy with no Zr does not form any NiO nodules even at oxidation times of 3000 and 18,000 hours.

The results of the long term oxidation experiments showed that NiO dominates the oxidation products in samples with more than about 0.15 wt. % Zr. Internal oxidation was highly concentrated in the vicinity of the Zr inclusions and the eutectic zones. A protective continuous $Al_2O_3$ layer does not form, rather, the surface oxide consist of a discontinuous mixture of $NiAl_2O_4$, NiO and $Al_2O_3$. The protective $Al_2O_3$ layer was found to be formed on the surface of the alloys with about 0.15% Zr or less. Mo was added in order to improve the high temperature strength and did not affect the oxidation behavior of the alloys.

The conclusions of the investigation show that the most suitable composition in order to avoid oxidation deterioration of transfer rolls are Ni aluminides that contain:

- zirconium ranging from 0 to 0.15 wt. %, preferably about 0.08-0.1 wt % Zr;
- molybdenum ranging from 2.5 to 3.0 wt. %, preferably about 2.8 wt % Mo;
- aluminum ranging from about 7.5 to 8.5 wt. %;
- chromium ranging from about 7.5 to 8.5 wt. %;
- boron maximum of 0.015 wt. %, but preferably about 0.01 wt. %,
- C, Si, Fe, S, Mn, P and Cu should be kept as low as possible, with aimed maximum concentrations indicated in the Table I; and
- other elements from the group IVB, VB and VIB of the periodic table should be kept as low as possible.

TABLE 1

| | Weight percent (wt. %) | | Atomic percent (at. %) | |
|---|---|---|---|---|
| Element | Aim composition | Range | Aim composition | Range |
| Ni | balance | balance | balance | balance |
| Al | 8 | 7.5-8.5 | 15.9 | 14.9-16.8 |
| Cr | 7.7 | 7.5-8.5 | 7.9 | 7.8-8.7 |
| Zr | 0.1 | 0.05-0.15 | 0.05 | 0.03-0.09 |
| Mo | 2.8 | 2.5-3.0 | 1.6 | 1.4-1.7 |
| B | 0.01 | 0.015 max | 0.050 | 0.05-0.07 |
| C | | 0.05 max | | |
| Si | | 0.1 max | | |
| Fe | | 0.3 max | | |
| S | | 0.005 max | | |
| Mn | | 0.1 max | | |
| P | | 0.01 max | | |
| Cu | | 0.3 max | | |

Ni-aluminide rolls with inventive alloy composition were centrifugal cast for production trial. Additional rolls with different chemical composition, including the prior art IC-221M chemistry, were also produced for the benchmarking of the new alloy. The tensile properties of the rolls were determined at varying temperatures up to 1000° C. in round 35 mm gauge section specimens. Table 2 lists the tensile properties of the inventive and prior art alloys.

TABLE 2

| | | Tensile Strength (ksi) | | | | | | |
|---|---|---|---|---|---|---|---|---|
| Temp. ° C. | Temp. ° F. | Experiment roll 2.1% Zr | Experiment roll 1.2% Zr | Experiment roll 0% Zr | Experiment roll 0.1% Zr | Production Roll 131 0.1% Zr | Production Roll 156 0.1% Zr | Production Roll 157 0.1% Zr |
| 25 | 70 | 100 | 100 | 132 | 122.8 | 105.3 | 107 | 98 |
| 700 | 1292 | 110 | 104 | 77.5 | 84.15 | 86.3 | 72.05 | 85.35 |
| 925 | 1697 | 80 | 77 | 29.3 | 42.55 | 31.1 | 30.25 | 26.25 |
| 982 | 1800 | 47 | 40 | 16.1 | 32.7 | 30.25 | 14 | 14 |
| 1038 | 1900 | | | | | 15.125 | | |

It is to be understood that the disclosure set forth herein is presented in the form of detailed embodiments described for the purpose of making a full and complete disclosure of the present invention, and that such details are not to be interpreted as limiting the true scope of this invention as set forth and defined in the appended claims.

What is claimed:

1. A nickel-aluminide ahoy comprising:

0.15 wt % or less Zr^

2.5 to 3.0 wt. % Mo;

7.5 to 8.5 wt. % Cr; and 7.5 to 8.5 wt. % Al; and the balance being Ni.

2. The nickel-aluminide alloy of claim 1, wherein said Zr ranges from about 0.08 to 0.1 wt %.

3. The nickel-aluminide alloy of claim 1, wherein said ahoy comprises about 2.8 wt % Mo.

4. The nickel-aluminide alloy of claim 1, wherein said alloy further comprises about 0.015 wt. % B or less.

5. The nickel-aluminide alloy of claim 4, wherein said alloy further comprises about 0.01 wt. % B.

6. The nickel-aluminide alloy of claim 1, wherein said alloy further comprises in wt. %: C—0.05 max; Si—0.1 max; Fe—0.3 max; S—0.005 max; Mn—0.1 max; P—0.01 max; and Cu—0.3 max.

7. The nickel-aluminide alloy of claim 6, wherein said alloy contains no more than trace amounts of the other elements from group IVB, VB and VIB of the periodic table.

8. A furnace roll comprising: a Cast roll of a nickel-aluminide alloy comprising:

0.15 wt % or less Zr 2.5 to 3.0 wt. % Mo;

7.5 to 8.5 wt. % Cr; and 7.5 to 8.5 wt. % Al; and the balance being Ni.

9. The furnace roll of claim 8, wherein said Zr ranges from about 0.08-0.1 wt %.

10. The furnace roll of claim 8, wherein said alloy further comprises about 2.8 wt % Mo.

11. The furnace roll of claim 8, wherein said alloy further comprises from about 0.015 wt. % B or less.

12. The furnace roll of claim 11, wherein said alloy further comprises about 0.01 wt. % B.

13. The furnace roll of claim 8, wherein said alloy further comprises in wt. %: C—0.05 max; Si—0.1 max; Fe—0.3 max; S—0.005 max; Mn—0.1 max; P—0.01 max; and Cu—0.3 max.

14. The furnace roll of claim 13, wherein said alloy contains no more than trace amounts of the other elements from group IVB, VB and VIB of the periodic table.

15. The furnace roll of claim 8, further comprising a protective $Al_2O_3$ layer after oxidation.

16. The furnace roll of claim 8, wherein after oxidation, NiO nodules are not present.

17. A nickel-aluminide ahoy comprising:

0.15 wt % or less Zr 2.5 to 3.0 wt. % Mo;

7.5 to 8.5 wt % Cr; and 7.5 to 8.5 wt % Al; and the balance being Ni, wherein the alloy contains no more than trace amounts of the other elements from group IVB, VB and VIB of the periodic table.

18. A furnace roll for comprising: a cast roll of a nickel-aluminide alloy comprising:

0.15 wt. % or less Zr 2.5 to 3.0 wt. % Mo;

7.5 to 8.5 wt. % Cr; and 7.5 to 8.5 wt. % Al; and the balance being Ni, wherein the alloy contains no more than trace amounts of the other elements from group IVB, VB and VIB of the periodic table.

19. The furnace roll of claim 8, further comprising:

a continuous protective layer of $Al_2O_{30}$n a surface of the nickel-aluminide alloy after oxidation of the furnace roll.

20. The furnace roll of claim 8, wherein NiO nodules do not form on a surface of the nickel-aluminide alloy during oxidation of the furnace roll.

* * * * *